US006725489B1

(12) United States Patent
Zell

(10) Patent No.: US 6,725,489 B1
(45) Date of Patent: Apr. 27, 2004

(54) AUTOMATIC POOL CLEANER ACCESSORY

(76) Inventor: Lothar J Zell, 8206 Babsdale Chase, Montgomery, AL (US) 36117

( * ) Notice: Subject to any disclaimer, the term of this patent is extended or adjusted under 35 U.S.C. 154(b) by 139 days.

(21) Appl. No.: 10/033,666

(22) Filed: Dec. 27, 2001

(51) Int. Cl.[7] ..... E04H 4/16

(52) U.S. Cl. ..... 15/1.7; 15/144.2; 15/145; 15/257.01; 294/19.1; 294/24

(58) Field of Search ..... 15/1.7, 1, 144.2, 15/145, 257.01; 210/169; 294/19.1, 24

(56) References Cited

U.S. PATENT DOCUMENTS

| | | | | | |
|---|---|---|---|---|---|
| 3,444,575 | A | * | 5/1969 | Martin | 15/1 |
| 3,731,334 | A | * | 5/1973 | Carbonell | 15/144.2 X |
| 3,936,899 | A | | 2/1976 | Henkin et al. | 15/1.7 |
| 4,433,863 | A | * | 2/1984 | Mathews | 294/19.1 |
| 4,449,265 | A | | 5/1984 | Hoy | 15/1.7 |
| 4,683,599 | A | | 8/1987 | Rief | 4/490 |
| 4,734,954 | A | * | 4/1988 | Greskovics et al. | 15/1.7 |
| 4,907,610 | A | | 3/1990 | Meincke | 134/56 R |
| 5,379,473 | A | | 1/1995 | Rief et al. | 15/1.7 |
| 5,469,596 | A | | 11/1995 | Rief et al. | 15/1.7 |
| 5,557,819 | A | | 9/1996 | Krolikowski | 15/1.7 |
| 5,709,793 | A | * | 1/1998 | Kisner | 210/169 |
| 5,720,068 | A | | 2/1998 | Clark et al. | 15/1.7 |
| 5,768,734 | A | | 6/1998 | Dietrich | 15/1.7 |
| 5,799,351 | A | | 9/1998 | Rief et al. | 15/1.7 |
| 5,842,243 | A | * | 12/1998 | Horvath et al. | 15/1.7 |
| 6,061,860 | A | | 5/2000 | Fitzgerald | 15/1.7 |

FOREIGN PATENT DOCUMENTS

| | | |
|---|---|---|
| GB | 1082620 | 9/1967 |

* cited by examiner

*Primary Examiner*—Mark Spisich
(74) *Attorney, Agent, or Firm*—Michael I Kroll

(57) ABSTRACT

Disclosed are a plurality of different fasteners that can connect a vacuum pole 14 to an automatic pool cleaner 12 so that the user can selectively relocate and direct the pool cleaner 12 to locations in a pool 18 that were previously missed or not yet cleaned. The vacuum pole 14 is an extending cylindrical pole having a throughbore 34 wherein a pole attachment 26 having a similar construction may be inserted and secured, being held structurally by a compression clip 44 having securing pins 32 that compress to then extend through securing holes 34, and frictionally by protrusions 38 that align into depressions 40. Secured within, and extending outward from the pole attachments is a universal ball joint 26 connected within a connection member 42 cavity 43 to provide a highly maneuverable surface wherein a selected fastener may be attached. To connect the pole attachment's mating fastener to the automatic pool cleaner, a fastener attachment plate 56 is provided. The fastener attachment plate 56 has a bottom surface replicating the structure of the automatic pool cleaner 12 so that it may be attached by an adhesive 28. The top surface of the plate 56 has the mating fastener for the pole attachment 24.

12 Claims, 12 Drawing Sheets

AUTOMATIC POOL CLEANER ACCESSORY

BACKGROUND OF THE INVENTION

1. Field of the Invention

The present invention relates generally to an automatic pool cleaner and, more specifically, to an accessory utilizing a plurality of different fastening means, that can connect a vacuum pole to an automatic pool cleaner so that a means for the user to selectively relocate and direct the pool cleaner to locations in a pool that were previously missed or not yet cleaned is provided. The attachment means consist of two mating members with one being attached to the end of a vacuum pole and the other fixedly attached to the surface of the automatic pool cleaner. The vacuum pole is an extending cylindrical pole having a throughbore wherein a pole attachment having a similar construction may be inserted and secured therein, being held structurally by a compression clip having securing pins that compress to then extend through securing holes, and frictionally by protrusions that align into depressions. Secured within, and extending outward from said pole attachment's throughbore is a universal ball joint connected within a connection member's cavity to provide a highly maneuverable surface wherein a selected fastener may be attached thereto. To connect the pole attachment's mating fastener to the automatic pool cleaner, a fastener attachment plate is provided. The fastener attachment plate has a bottom surface replicating the structure of the automatic pool cleaner so that it may be attached thereto by an adhesive or other bonding means, the top surface of the plate has attached thereto the mating fastener for the pole attachment. One such fastening means to connect the vacuum pole to the automatic pool filter being a piece of hook and loop material placed on the vacuum poles connection member with a piece of mating hook and loop material attached to the automatic pool filter wherein they may be joined with a hook and loop connection. Another means for fastening the said pole and automatic pool cleaner is a hook and ring, to form a connection whereby the hook fastener is impaled and grabbed through the center of the ring. Yet another means for connecting said pole and pool cleaner is by a mating threaded or bayonet style fastener that can be turned into its complimentary threaded or bayonet style aperture fastener. Furthermore suction may also be used as a fastening means between the said pole and automatic pool cleaner by having a suction cup applied to the vacuum poles connection member with the said connection plate having a planer smooth surface adhered or bonded to the automatic pool filter whereby the suction cup may be compressed onto the plates surface and attached thereto by suction.

2. Description of the Prior Art

There are other automatic pool cleaner accessories designed for the use of cleaning a pool. Typical of these is U.S. Pat. No. 3,936,899 issued to Henkin on Feb. 10, 1976.

Another patent was issued to Hoy on May 22, 1984 as U.S. Pat. No. 4,449,265. Yet another U.S. Pat. No. 4,683,599 was issued to Rief on Aug. 4, 1987 and still yet another was issued on Mar. 13, 1990 to Meincke as U.S. Pat. No. 4,907,610.

Another patent was issued to Rief et al on Jan. 10, 1995 as U.S. Pat. No. 5,379,473. Yet another U.S. Pat. No. 5,469,596 was issued to Ref et al. on Nov. 28, 1995. Another was issued to Krolikowski on Sep. 24, 1996 as U.S. Pat. No. 5,557,819 and still yet another was issued on Feb. 24, 1998 to Clark, et al as U.S. Pat. No. 5,720,068.

Another patent was issued to Dietrich on Jun. 23, 1998 as U.S. Pat. No. 5,768,734. Yet another U.S. Pat. No. 5,799,351 was issued to Reif, et al on Sep. 1, 1998. Yet another U.S. Pat. No. 6,061,860 was issued to Fitzgerald on May 16, 2000. Still yet another U.K. Pat. No. 1,082,620 was issued to Conrad on Sep. 6, 1966.

An automatic swimming pool cleaner comprised of a car adapted to travel underwater along a random path on the pool vessel surface for dislodging debris therefrom. The car wheels are driven by a water powered turbine to propel the car in a forward direction, along the vessel surface. In order to prevent the car from being driven into a position, as for example against a vertical wall, from which it cannot emerge, a wheel geometry is employed which, upon contact, develops a horizontal force component parallel to the vertical wall, to thus enable the car to spin off. Alternatively, or in combination, a water flow produced reaction force can produce a torque to turn the car with respect to the engaged wheel to enable the car to spin off. The car is designed with a low center of gravity and a relatively buoyant top portion so as to produce a torque which maintains the car correct side up when on the pool bottom. Means are provided on the car for producing a water flow having force component perpendicular to the vessel surface to provide good traction between the car wheels and the vessel surface. Further, a water flow produced suction is created adjacent to the vessel surface for collecting debris into a basket carried by the car. In addition, one or more hoses is pulled by the car and whipped by water flow to sweep dirt from the vessel surface.

A vacuum powered automatic swimming pool sweep for cleaning the bottom of a swimming pool comprising a hollow housing supported by at least one pair of reversible wheels, a reversible impeller disposed within the hollow housing, the reversible impeller including an impeller housing having an impeller chamber formed therein, a reversible impeller member having at least one pair of opposing vanes coupled thereto operatively disposed within the impeller chamber and interconnected to the pair of reversible wheels, a fluid flow conduit including a first and second fluid flow path coupled between an external vacuum line and the impeller chamber, a directional control in communication with the fluid flow conduit to selectively direct water from the pool through the impeller chamber to impinge on the movable vanes coupled to the reversible impeller member to drive the pair of reversible wheels.

An underwater fitting is provided to allow a controlled leak of water into a suction line between a filter installation and an automatic pool cleaner. The fitting is T-shaped with the head of the T in the suction line and the leg of the T controlled by a tapered mandrel in an orifice which are adjustable to vary the effective orifice area. The mandrel is spring biased so that is can be pushed back in case of a complete stoppage of flow from the cleaner.

A cleaning system for a swimming pool which includes a mobile cleaning unit and/or stationary cleaning heads. Manual and automatic modes are included. The system is suitable for both gunnite and polymer liner pools, spas and the like. No energy is required other than that normally required for circulation of water through the conventional filtration apparatus.

An automatic swimming pool cleaner having a vibrator on the pool cleaner housing, main bristles projecting to main-bristle ends for supporting the device on a surface to be cleaned, the main bristles inclined such that vibration causes forward movement, and secondary bristles in fixed position projecting to secondary-bristle ends, the secondary bristles inclined in a different direction than the main bristles such that, upon contact with the surface to be cleaned, vibration causes a turning away from the forward direction.

An automatic swimming pool cleaner of the type driven by water flow, having a housing forming a chamber open at its lower side, pivotable attachment of a hose, and a handle pivotably and detachably secured to the housing, such that the pool cleaner can be used manually or automatically as desired. Various embodiments of the invention include vibratory bristle drive to provide forward motion, directional change, rotational scrubbing, and/or vibratory scrubbing action for dual-use (automatic or manual) and manual cleaning apparatus.

An improved pool cleaner hose assembly is provided for use in drawing water under a negative pressure from a manually operated pool cleaner device to a water filtration system for swimming pools and the like. Improvements relate to enhancements in the view of the operator on debris at the bottom of the swimming pool during cleaning operation. The hose assembly is coupled between the cleaner device and filtration system. An improved cleaner hose assembly comprising a conventional extruded plastic hose and a plurality of weights attached along the length of the hose to orient the hose at the lowest profile on the pool floor whereby imparting minimum disturbance to the water surface and enhancing the view of the operator.

Automatic swimming pool cleaning systems are disclosed. The systems include an automatic swimming pool cleaner incorporating one or more curved wipers protruding from its lower surface. The wipers and flat bottom of the cleaner induce a vortex as fluid flows to its central inlet, entraining debris in the flow. A fluted throat surrounding the inlet additionally assists the interior of the base of the cleaner in retaining debris when opened for cleaning, additionally providing an improved flow path for enhanced debris pick-up. Also disclosed is a valve useful for controlling and indicating the rate of fluid flow to a cleaner. Included within the valve is a plunger attached to a spring, with the spring force opposing fluid flow through the valve. Flow sufficient to overcome the spring force compresses the spring, however, thereby moving the plunger within the tube and providing a dynamic indication of the rate of fluid flow. A diffuser and fluid release ports permit the valve to be adjusted to achieve a desired flow rate.

A self-contained swimming pool vacuum includes a submersible vacuum head having a housing including opposing symmetrical halves which attach together to define an elongate vacuum mouth at a bottom end, a discharge opening at the opposite upper ends and a thrust channel extending therebetween. A motor supported within the thrust channel when the symmetrical halves of the housing are joined together, drives a propeller to create a thrust through the housing from the vacuum mouth through the thrust channel and out from the discharge opening at the top of the housing. A catch bag, removably secured to the top discharge opening, collects debris sucked through the vacuum mouth. First and second primary wheels are rotatably mounted on opposite ends of the housing, adjacent the vacuum mouth, to provide a cantilever effect when maneuvering the vacuum head along a surface. The housing is further provided with drag wheels on opposing leading and trailing edges and a swivel yoke mount structured for attachment to a hollow pole to manipulate the submerged vacuum head about the surfaces of a swimming pool.

A pool cleaner having an improved self-starting vibratory power source including a power-source chamber between downstream hose connection and a substantially open upstream chamber inlet and a vibrator with a downstream pivot thereon about which it pivots in the chamber, the vibrator mounted and sized such that all vibrator positions are unstable and flow is substantially unrestricted in all vibrator positions. Preferred embodiments include a drive mechanism mechanically linked to the vibratory power source.

A compact assembly (40) with a turbine (20) fixed to a rotating drive shaft (22) with an extensible joint connected to small brush (38) by a shaft on the brush (36). The assembly (40) is inserted into a standard pool vacuum head (50) suction cavity (52) to provide a localized scrubbing action. The brush (38) is powered by the water pulled through the suction cavity (52) in the vacuum head (50) driving the turbine (20) causing rotation of the drive shaft (22) and brush shaft (36). The brush (38) is mounted to the end of the brush shaft (36). A spring (34) that is placed coaxial about the brush shaft (36) holds the brush (38) in contact with the surface (70) being scrubbed clean.

A swimming pool vacuum cleaner, characterized in thin, that a head in the form of a substantially flat plate with a marginal flange thereon is provided with means for supporting said head for movement in spaced relation along the wall of a swimming pool to be cleaned, and that the said plate thus facing the pool wall is provided within embossment provided with spaced apart transverse arcuate grooves extending partially around a tubular throat adapted to be connected to a source of vacuum, whereby when the head is placed in the water containing pool with said means of supporting the head in engagement with a wall thereof, the water between the head and said wall will be caused to perform a swirling action toward and into said tubular throat.

While these automatic pool cleaner accessories may be suitable for the purposes for which they were designed, they would not be as suitable for the purposes of the present invention, as hereinafter described.

SUMMARY OF THE PRESENT INVENTION

The present invention discloses a plurality of different fastening means that can connect a vacuum pole to an automatic pool cleaner so that the user can selectively relocate and direct the pool cleaner to locations in a pool that were previously missed or not yet cleaned. The vacuum pole is an extending cylindrical pole having a throughbore wherein a pole attachment means having a similar construction may be inserted and secured therein, being held structurally by a compression clip having securing pins that compress to then extend through securing holes, and frictionally by protrusions that align into depressions. Secured within, and extending outward from the pole attachments is a universal ball joint connected within a connection member cavity to provide a highly maneuverable surface wherein a selected fastener maybe attached thereto. To connect the pole attachment's mating fastener to the automatic pool cleaner, a fastener attachment plate is provided. The fastener attachment plate has a bottom surface replicating the structure of the automatic pool cleaner so that it may be attached thereto by an adhesive or other bonding means. The top surface of the plate has attached thereto the mating fastener for the pole attachment. Alternative means for attachment include hook and loop material, a hook and ring fastener, a mating male and female threaded fastener, a mating male and female bayonet fastener, and a suction cup.

A primary object of the present invention is to provide an automatic pool cleaner accessory that provides the user the ability to redirect and position an automatic pool cleaner while in operation.

Another object of the present invention is to provide a vacuum pole that has a pole attachment that may connect structurally therein through securing pins that are compressed to then expand into securing holes.

Yet another object of the present invention is to provide a vacuum pole that has a pole attachment that may connect frictionally therein through protrusions and depressions.

Still yet another object of the present invention is to provide a vacuum pole having a universal ball joint connected to a connection member for the attachment of fasteners thereto.

Yet another object of the present invention is to provide a fastener attachment plate to hold a fastener to an automatic pool cleaner through an adhesive or bonding process.

Still yet another object of the present invention is to provide a automatic pool cleaner accessory with hook and loop fasteners to provide a fastening means between the vacuum pole and automatic pool filter.

Yet another object of the present invention is to provide a automatic pool cleaner accessory with a hook and ring as a fastening means between the vacuum pole and automatic pool filter.

Yet another object of the present invention is to provide a automatic pool cleaner accessory with a threaded or bayonet type fastener that is turned to form a connection between the vacuum pole and automatic pool filter.

Yet another object of the present invention is to provide a automatic pool cleaner accessory with suction cup that is pressed onto a flat planer surface to form a connection means between the vacuum pole and automatic pool filter.

Additional objects of the present invention will appear as the description proceeds.

The present invention overcomes the shortcomings of the prior art by providing an automatic pool cleaner accessory that provides a means for the user to redirect and position an automatic pool cleaner while in operation by using a vacuum pole having a pole attachment that connects therein by either a structural or frictional connection, with said pole attachment having a universal ball joint attached to a connection member having one of a plurality of possible fasteners equipped thereon that can then be attached to its respective fastener connected to the automatic pool cleaner via a fastener attachment plate. Additionally, means of fastening the attachment pole to the fastener attachment plate may be not limited to but including mating hook and loop fasteners, a hook that grabs a ring, a treaded or bayonet type fastener that is inserted into a threaded or bayonet type aperture fastener or a suction cup that can attach though suction to a flat planer surface.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
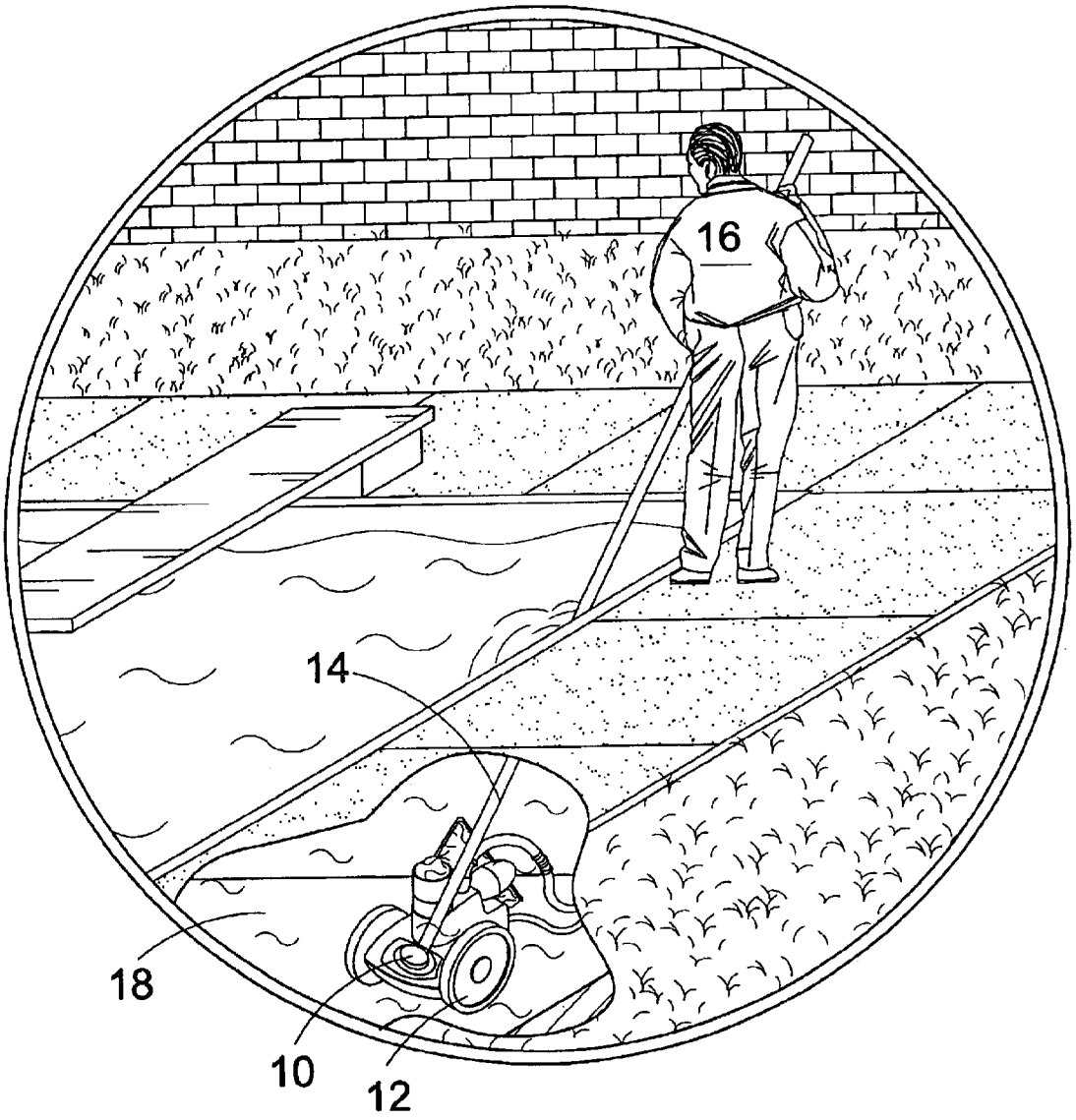
FIG. 1 is an illustrative view of the present invention.

With regard to reference numerals used, the following numbering is used throughout the drawings.

10 present invention
12 pool cleaner
14 pole
16 user
18 pool
20 hook and loop material
22 mating hook and loop material
24 pole attachment member
26 universal ball joint
28 bonding material
30 wall
32 securing pins
34 bore of pole
36 securing holes
38 protrusions
40 depressions
42 connecting member
43 cavity
44 compression clip
46 ring fastener
48 hook fastener
50 plate
52 male threaded fastener
54 female threaded fastener
56 plate
58 threads
60 male bayonet fastener
62 female bayonet fastener
64 suction cup

DETAILED DESCRIPTION OF THE PREFERRED EMBODIMENT(S)

The following discussion describes in detail one embodiment of the invention and several variations of that embodiment. This discussion should not be construed, however, as limiting the invention to those particular embodiments. Practitioners skilled in the art will recognize numerous other embodiments as well. For a definition off the complete scope of the invention, the reader is directed to the appended claims.

Turning to FIG. 1, shown therein is an illustrative view of the present invention 10. Depicted is the present invention 10 providing an attachment means between an automatic pool cleaner 12 and vacuum pole 14, having mating hook and loop fasteners whereby the user 16 may actively participate in manipulating the positioning and displacement of the automatic pool cleaner 12 to cover any uncleaned spots and speed up the process of cleaning the surface of the pool 18.

Figure 2:
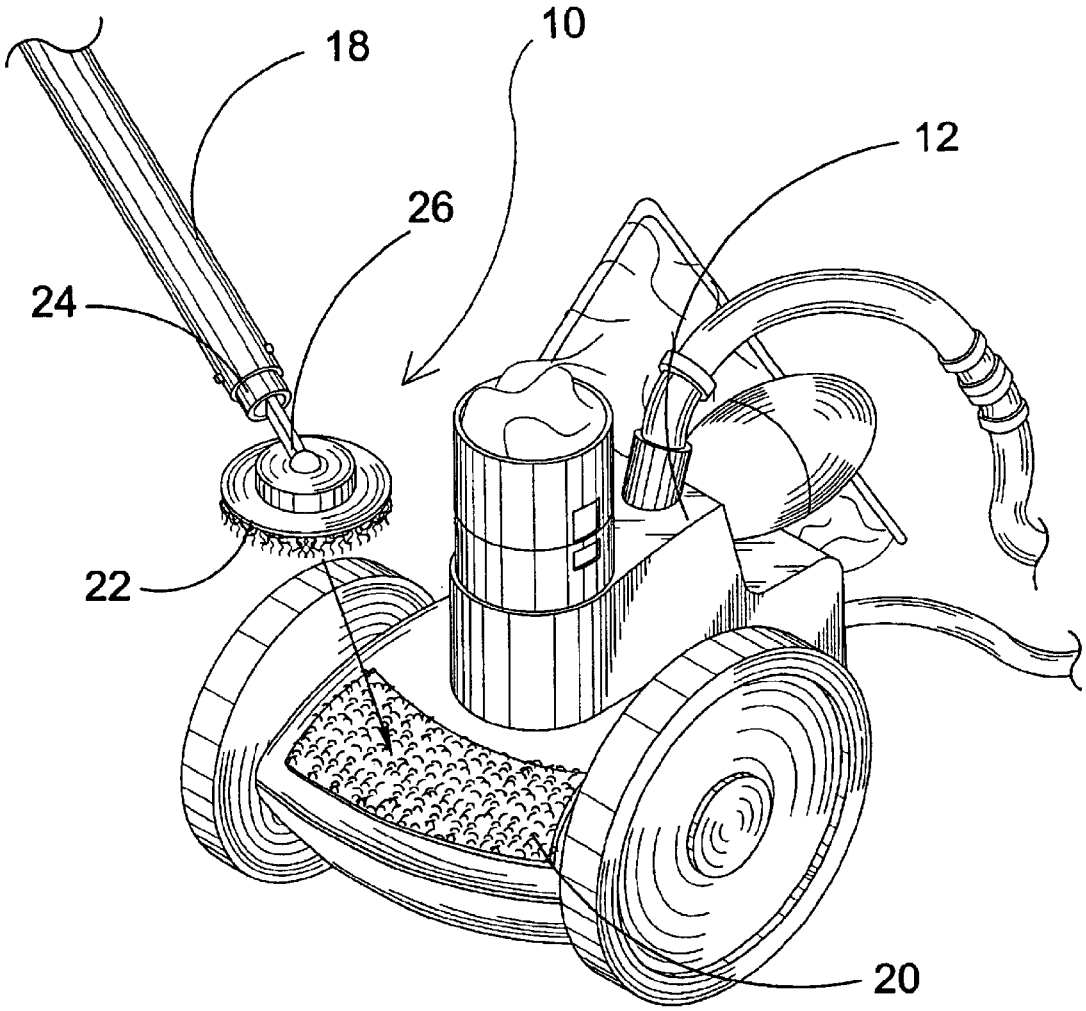
FIG. 2 is a perspective view of the present invention.

Turning to FIG. 2, shown therein is a perspective view of the present invention 10. Shown is the present invention 10 comprising two primary portions, one being hook and loop material 20 attached to the front outside surface of an automatic pool cleaner 12, the other being a vacuum pole 14 connected to a pole attachment means 24 having a universal ball joint 26, with mating hook and loop fasteners 22 attached thereto.

Figure 3:
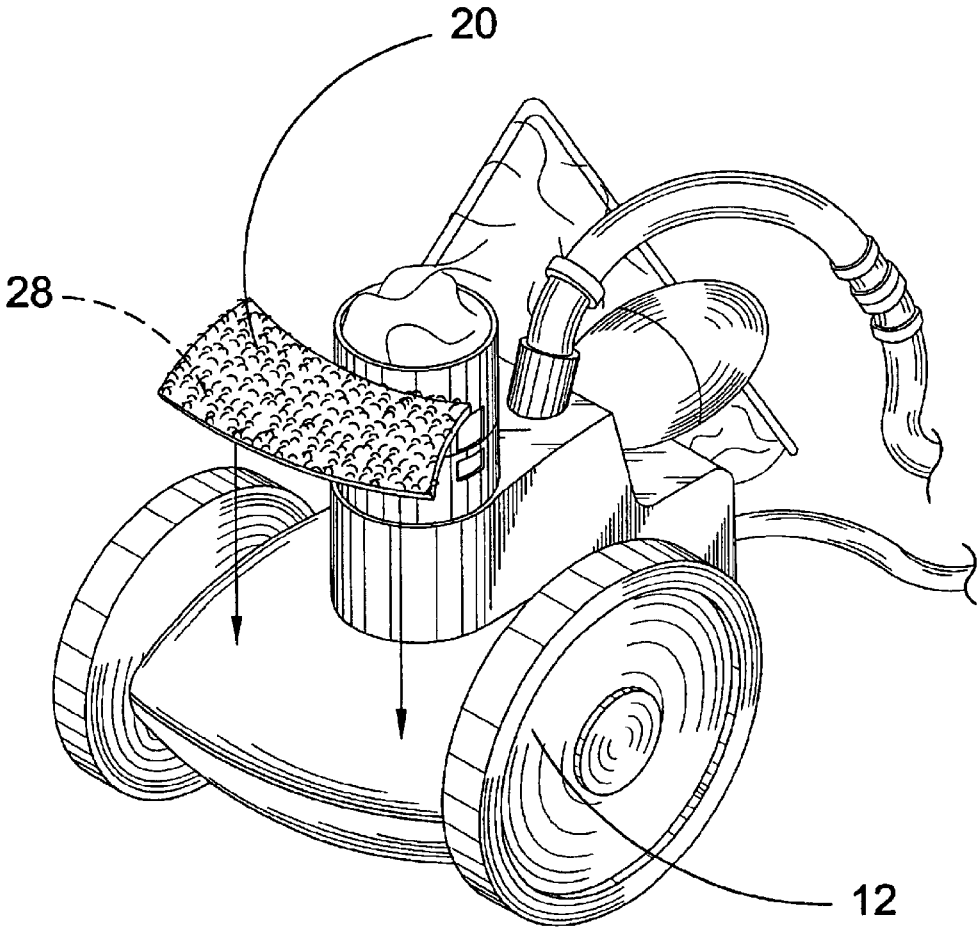
FIG. 3 is a perspective view of the present invention.

Turning to FIG. 3, shown therein is a perspective view of the present invention. Shown is the present invention having hook and loop material 20 bonded by adhesive 28 means to the front exterior surface of an automatic pool cleaner 12 to provide a surface on the automatic pool cleaner for a mating hook and loop fastener to be attached.

Figure 4:
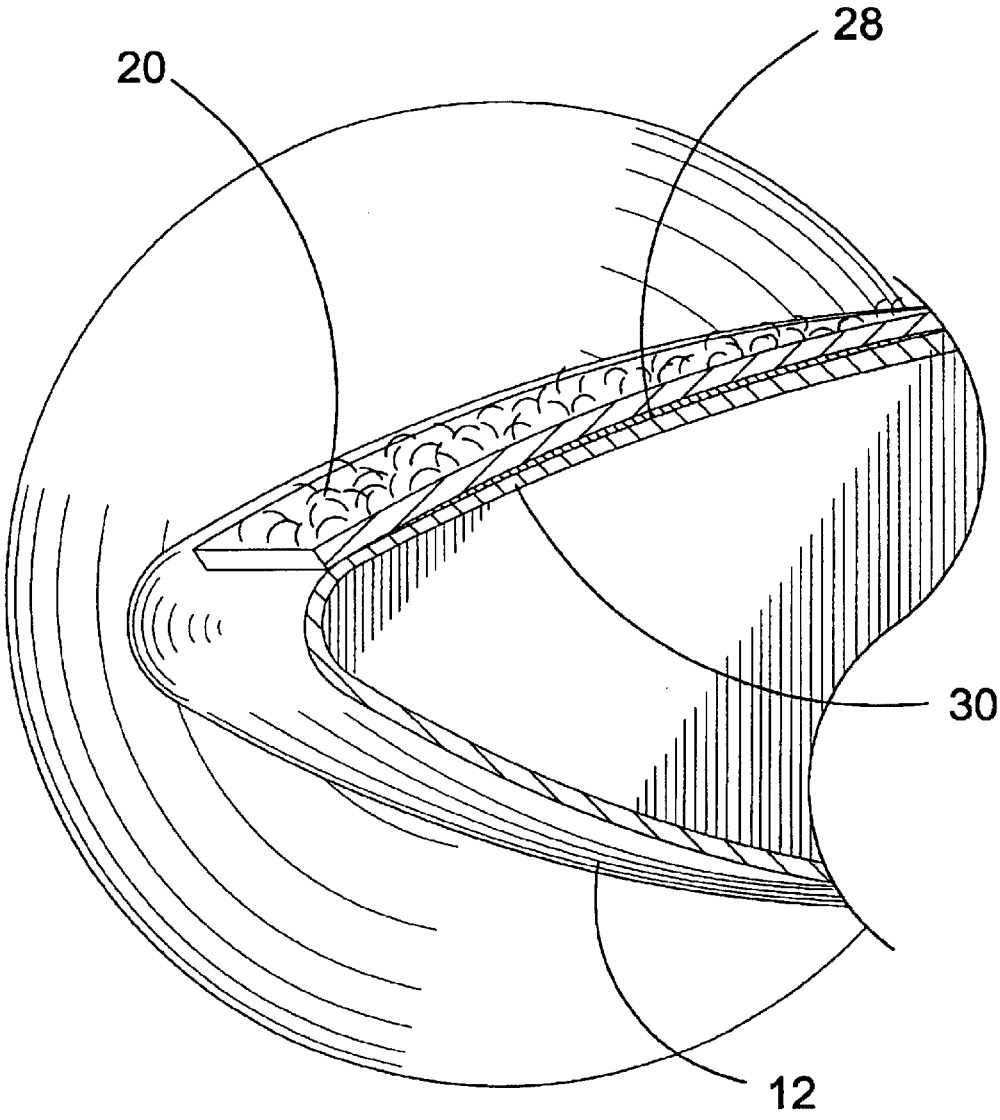
FIG. 4 is a sectional view of the present invention.

Turning to FIG. 4, shown therein is a sectional view of the present invention. Shown is the present invention being hook and loop material 20 disposed on the front wall 30 outer surface of the automatic pool cleaner 12 and held in place by a bonding material 28 such as adhesive. Additionally, fasteners, hardware or other bonding materials may also be used instead of or in conjunction with an adhesive.

Figure 5:
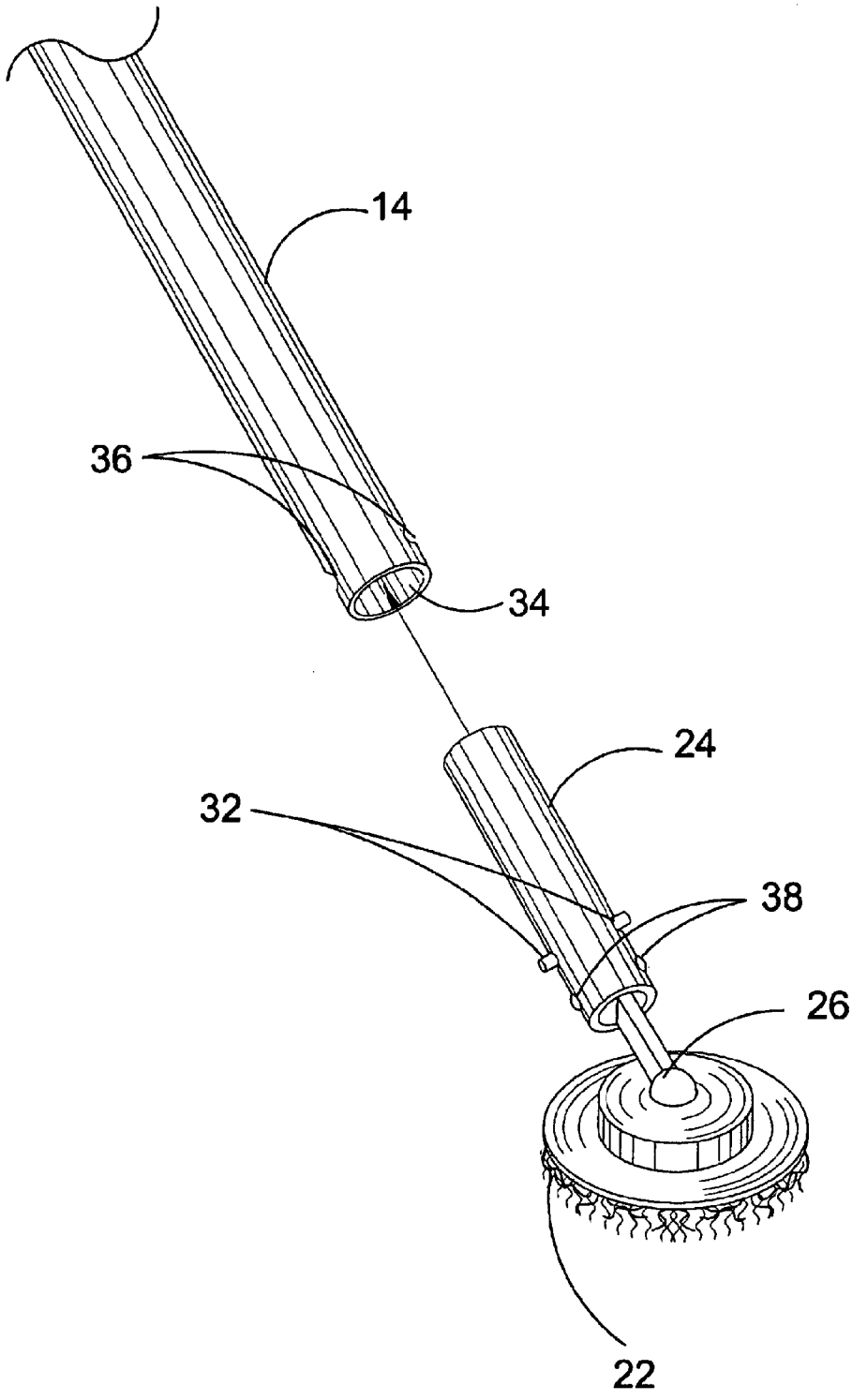
FIG. 5 is a perspective view of the pole attachment.

Turning to FIG. 5, shown therein is a perspective view of the pole attachment means 24. Shown is the pole attachment member 24 of the present invention having a pole attachment 24 with a universal ball joint 26 that has mating hook and loop fasteners 22 attached thereto. The pole attachment is connected to the vacuum pole 14 using a plurality of securing pins 32 that compress when the pole attachment 24 is inserted into the bore 34 of the vacuum pole 14 and expand when aligned with the securing holes 36. Multiple protrusions 38 are also provided on the pole attachment member 24.

Figure 6:
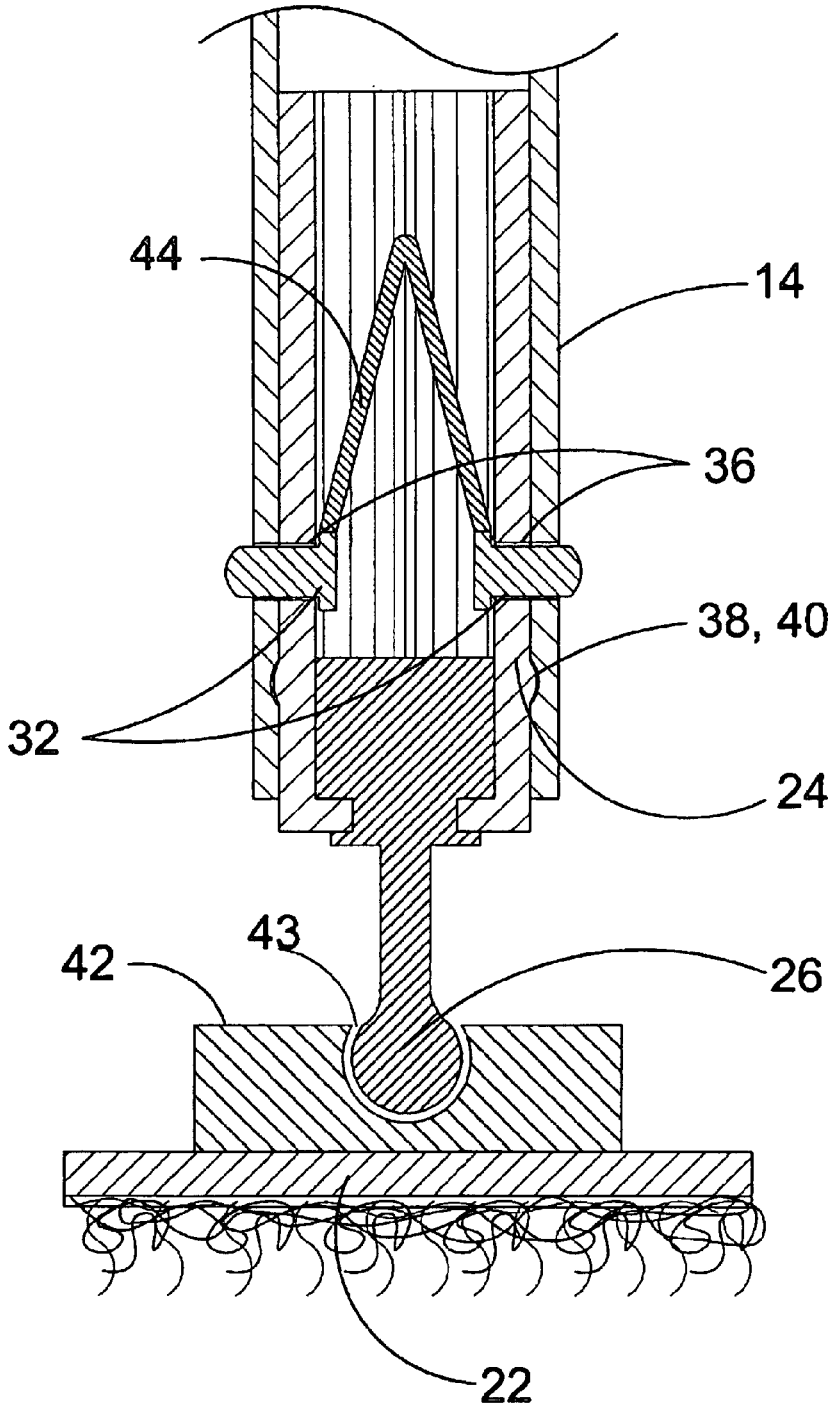
FIG. 6 is a sectional view of the pole attachment and vacuum pole.

Turning to FIG. 6, shown therein is a sectional view of the pole attachment means 24 and vacuum pole 14. Shown is the pole means 24 connected to the vacuum pole 14 by a plurality of laterally extendable compressible securing pins 32 on a compression clip 44 inside the vacuum pole's securing holes 36 and a plurality of protrusions 38 that align within depressions 40. Also shown is a universal ball joint 26 built into the connecting member structure 42 using cavity 43 of the pole attachment's connection member 24 to provide a maneuverable attachment to help the user move the mating hook and loop fastener 22 to its complementary fastener.

Figure 7:
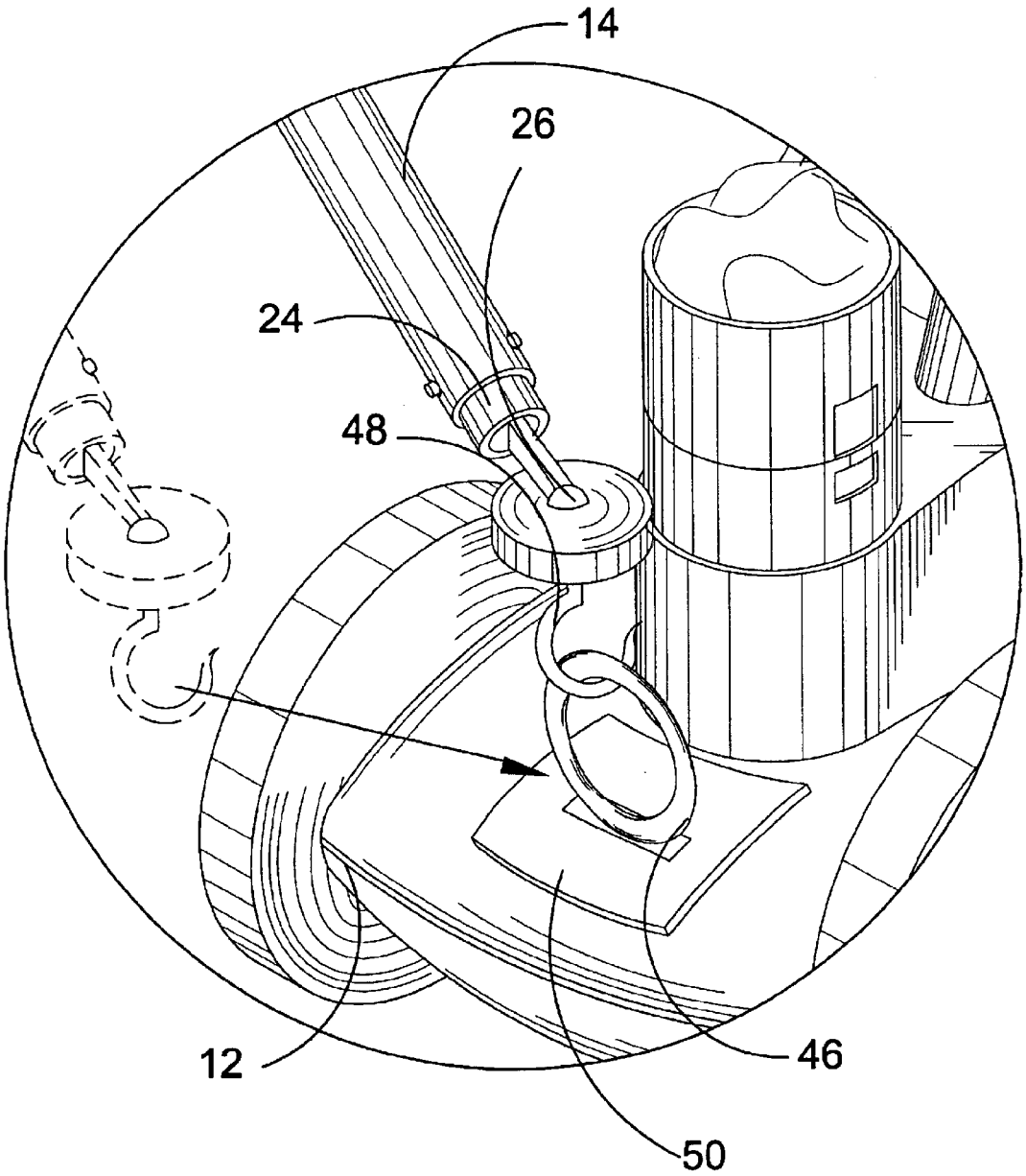
FIG. 7 is a detailed view of an additional fastening means.

Turning to FIG. 7, shown therein is a detailed view of an additional fastening means. Shown is an additional means for forming a connection between the vacuum pole 14 and automatic pool 12 consisting of a ring fastener 46 attached by means of a plate 50 that is impaled and grabbed through its center by a mating hook fastener 48. Other elements previously disclosed are also shown.

Figure 8:
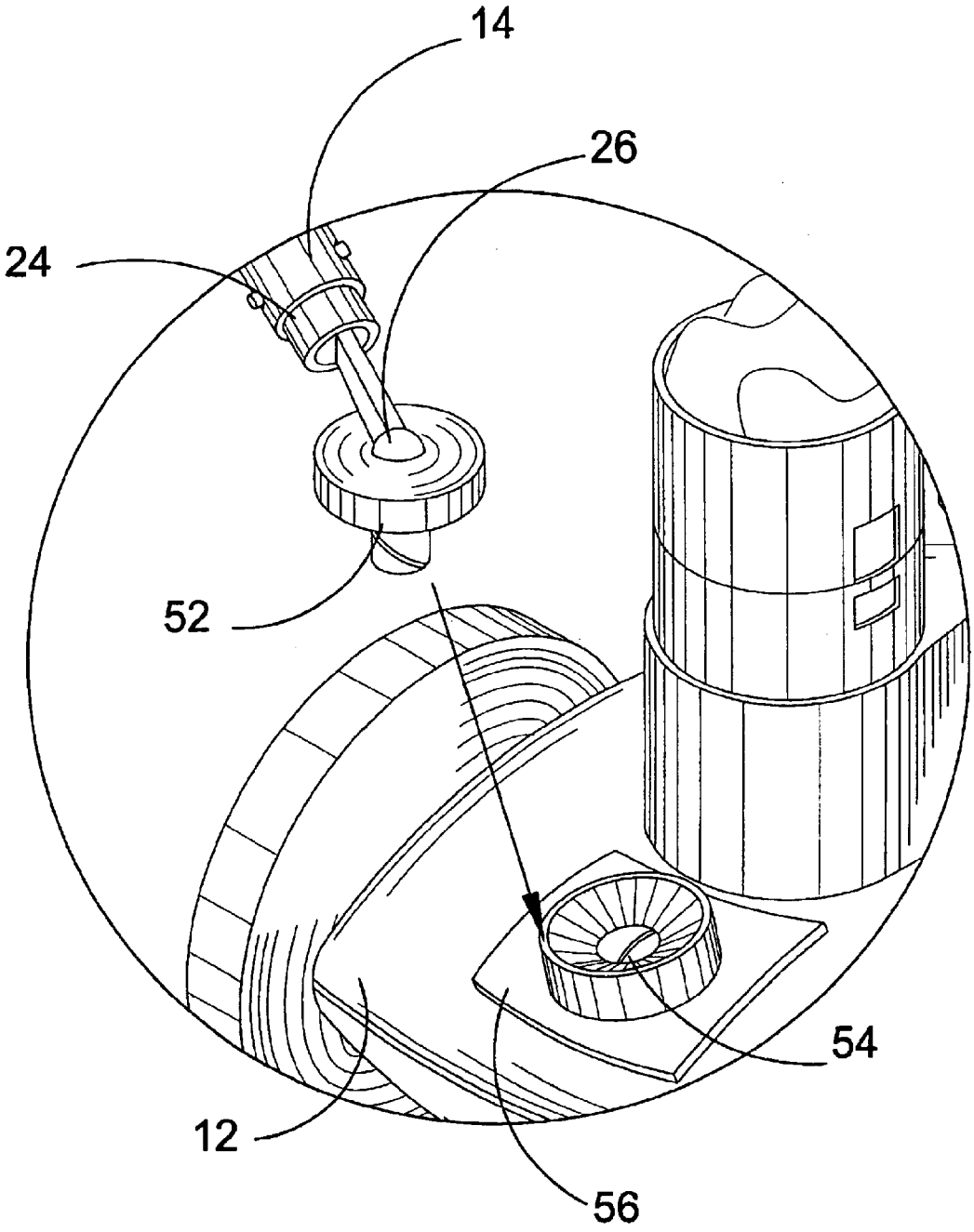
FIG. 8 is a detailed view of an additional fastening means.

Turning to FIG. 8, shown therein is a detailed view of an additional fastening means. Shown is the present invention having an additional means for forming a connection consisting of a mating male threaded fastener 52 that is placed and rotated into a threaded female aperture fastener 54 attached by means of a plate 56. Other elements previously disclosed are also shown.

Figure 9:
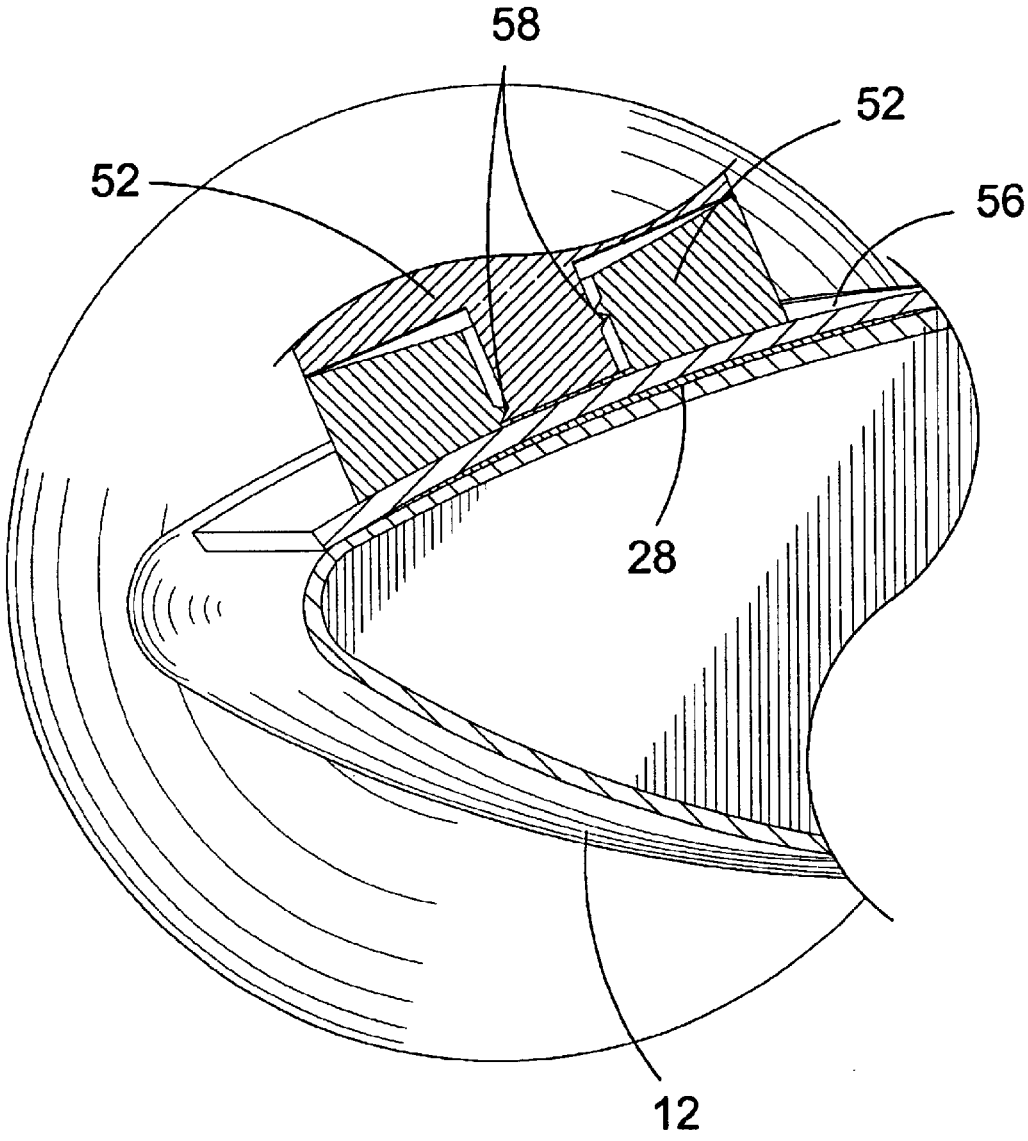
FIG. 9 is a sectional view of an additional fastening means.

Turning to FIG. 9, shown therein is a sectional view of an additional fastening means. Shown is the mating male threaded fastener 52 inserted and rotated into the threaded female aperture fastener 52 forming a connection. Threads 58 on the fasteners have a large spacing between one another to provide a minimal required fastening rotation needed to form a connection. Also shown is a fastener connection plate 56 to provide ample surface area for any type of bonding material's 28 application to the pool cleaner 12.

Figure 10:
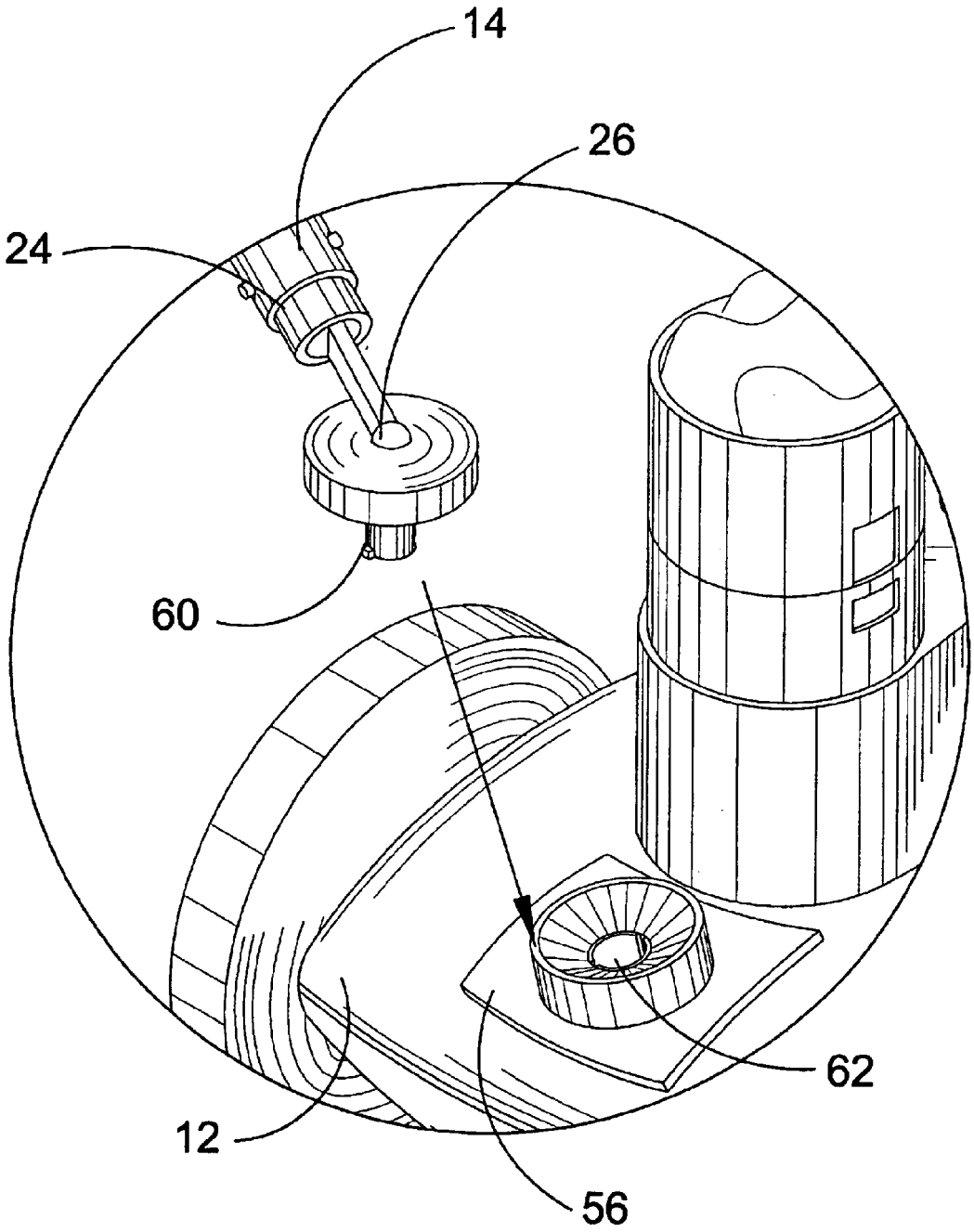
FIG. 10 is a is a detailed view of an additional fastening means.

Turning to FIG. 10, shown therein is a is a detailed view of an additional fastening means. Shown is an additional means for forming a connection, comprising a mating male bayonet fastener 60 and a bayonet female aperture fastener 62 that connects by the insertion and rotation of the mating bayonet fastener into the bayonet aperture fastener 62 as would be done in the standard manner by one skilled in the art. Other elements previously disclosed are also shown.

Figure 11:
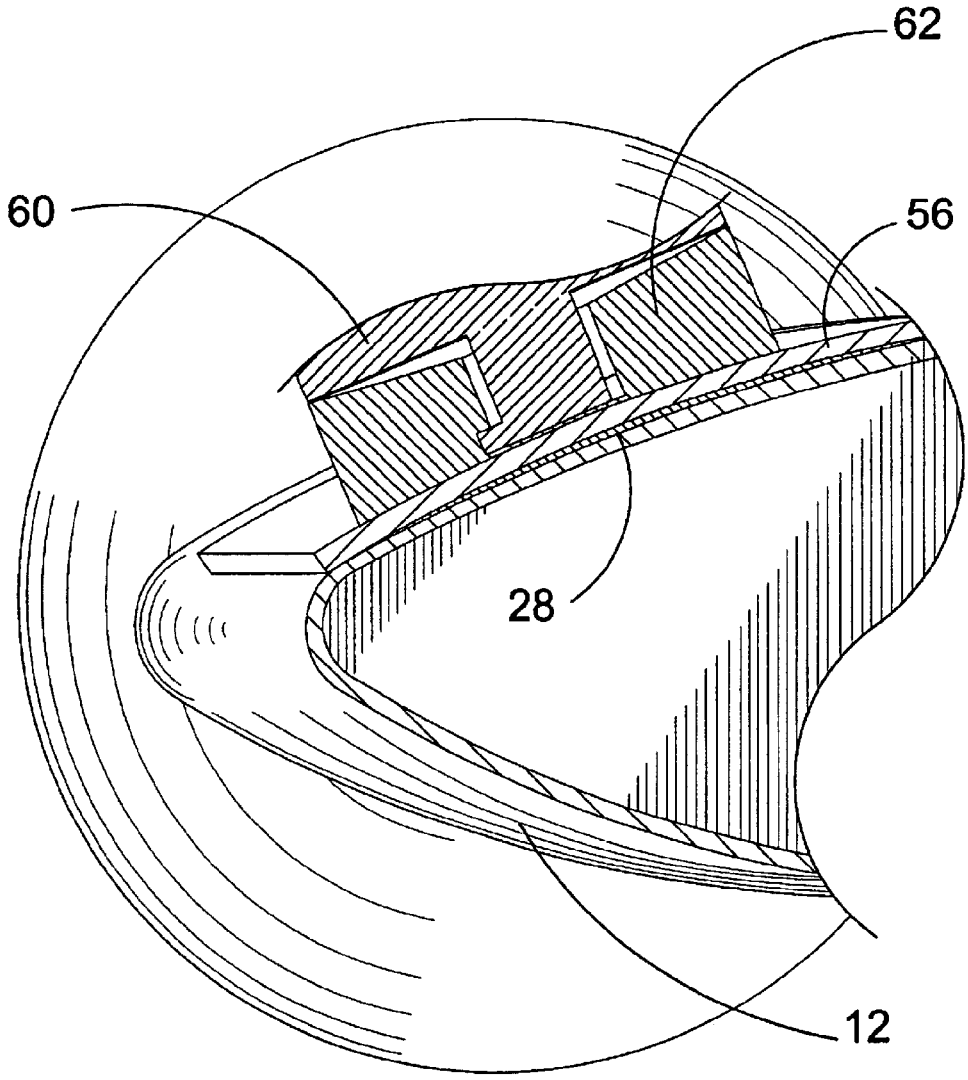
FIG. 11 is a sectional view of an additional fastening means.

Turning to FIG. 11, shown therein is a sectional view of an additional fastening means. Shown is the mating male bayonet fastener 60 attached within the bayonet female aperture fastener 62 to form a bond between the vacuum pole and automatic pool cleaner 12. Other elements previously disclosed are also shown.

Figure 12:
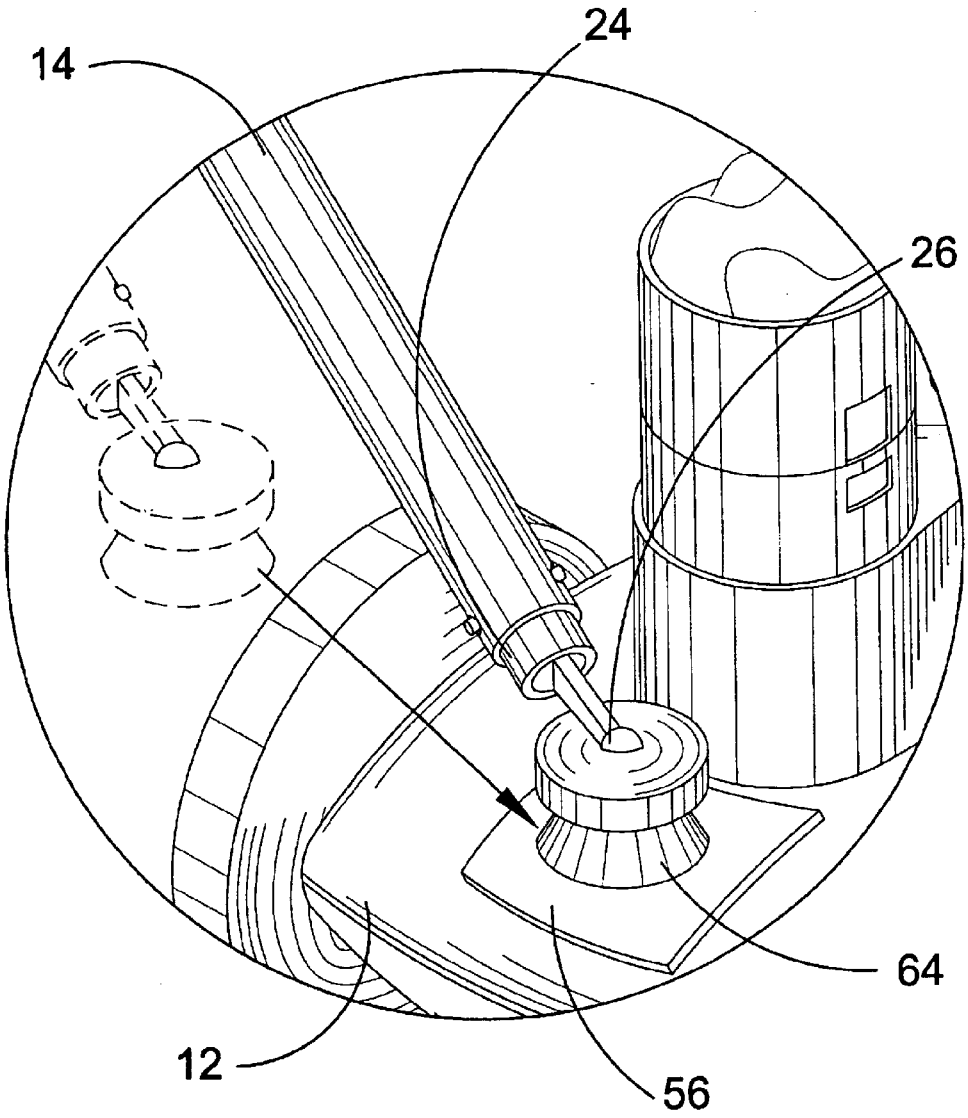
FIG. 12 is a is a detailed view of an additional fastening means.

Turning to FIG. 12, shown therein is a is a detailed view of an additional fastening means. Shown is the present invention with the fastening means being a suction cup 64 that is fastened to a flat attachment plate 56 by applying pressure on the flat attachment plate 56 with the suction cup 64 to produce a vacuum inside the suction cup that forms a vacuum bond. Other elements previously disclosed are also shown.

What is claimed is:

1. A swimming pool cleaning apparatus, comprising:

a) an automatic pool cleaner, said cleaner having a housing, said housing having a front, a rear, an upper surface and a lower surface;

b) a vacuum pole, said pole being elongated, said pole having a bore therein, said pole having a first and a second end, said first end for attachment to said upper surface of said housing of said pool cleaner and said second end for being grasped by a user;

c) means for connecting said vacuum pole to said housing of said pool cleaner whereby the pole can be manipulated by a user to steer the pool cleaner; and d) said first end of said pole having a pair of securing holes disposed in the walls thereof, said securing holes being oppositely disposed for receiving a pair of securing pins, and said first end of said pole also having a pair of depressions disposed in the walls thereof, said depressions being oppositely disposed for receiving a pair of protrusions.

2. The apparatus of claim 1, wherein said means for connecting said vacuum pole to said housing further comprises a pole attachment member, said pole attachment member having a first end and a second end, said first end for attachment to said housing and said second end for attachment to said first end of said pole.

3. The apparatus of claim 2, wherein said second end of said pole attachment member further comprises a cylindrical portion for insertion into said bore of said pole, said cylindrical portion having a bore therein, said cylindrical portion having a pair of holes in the walls thereof, said holes being oppositely disposed for receiving a pair of securing pins.

4. The apparatus of claim 3, further comprising a compression clip disposed in said bore of said cylindrical portion of said pole attachment member, said clip having a pair of securing pins laterally disposed on the ends thereof, said pins for insertion through said pair of holes of said pole attachment member and said securing holes of said pole, wherein said pair of holes of said pole attachment member align with said securing holes of said pole.

5. The apparatus of claim 4, wherein said cylindrical portion of said pole attachment member has a pair of protrusions thereon, said protrusions being oppositely disposed, said protrusions mating with said depressions disposed in the walls of said first end of said pole.

6. The apparatus of claim 5, further comprising a universal ball joint disposed on said first end of said pole attachment member, wherein said ball joint comprises a ball disposed in a connecting member, said connecting member being a disk-like member having a top side and a bottom side, said top side having a cavity therein for receiving said ball thereby forming a ball joint on said top side of said connecting member.

7. The apparatus of claim 6, further comprising a first and a second mating hook and loop material member, said first piece of hook and loop member being disposed on said bottom side of said disk-like connecting member and said second mating hook and loop member being disposed on said housing of said pool cleaner, said second mating hook and loop member further comprising means for bonding to said housing of said pool cleaner.

8. The apparatus of claim 6, further comprising a hook disposed on said bottom side of said disk-like connecting member and a mating ring for receiving said hook disposed on said housing of said pool cleaner, said ring further comprising a plate, said plate further comprising means for bonding to said housing of said pool cleaner.

9. The apparatus of claim 6, further comprising a male threaded member disposed on said bottom side of said disk-like connecting member and a mating female threaded member for receiving said male threaded member disposed on said housing of said pool cleaner, said female threaded member further comprising a plate, said plate further comprising means for bonding to said housing of said pool cleaner.

10. The apparatus of claim 6, further comprising a male bayonet fastener member disposed on said bottom side of said disk-like connecting member and a mating female bayonet fastener member for receiving said male bayonet member disposed on said housing of said pool cleaner, said female bayonet member further comprising a plate, said plate further comprising means for bonding to said housing of said pool cleaner.

11. The apparatus of claim 6, further comprising a suction cup member disposed on said bottom side of said disk-like connecting member and a plate for receiving said suction cup member disposed on said housing of said pool cleaner, said plate further comprising means for bonding to said housing of said pool cleaner.

12. The apparatus of claim 11, wherein said means for bonding further comprises an adhesive.

* * * * *